US010799866B2

(12) United States Patent
Fujimoto

(10) Patent No.: US 10,799,866 B2
(45) Date of Patent: Oct. 13, 2020

(54) MICROFLUIDIC CHIP

(71) Applicant: SUMITOMO RUBBER INDUSTRIES, LTD., Kobe-shi, Hyogo (JP)

(72) Inventor: Kentaro Fujimoto, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 213 days.

(21) Appl. No.: 15/656,210

(22) Filed: Jul. 21, 2017

(65) Prior Publication Data

US 2018/0043358 A1 Feb. 15, 2018

(30) Foreign Application Priority Data

Aug. 15, 2016 (JP) ..... 2016-159106

(51) Int. Cl.
*B01L 99/00* (2010.01)
*B01L 3/00* (2006.01)

(52) U.S. Cl.
CPC ... *B01L 3/50273* (2013.01); *B01L 2300/0816* (2013.01); *B01L 2300/0867* (2013.01); *B01L 2300/0887* (2013.01); *B01L 2400/0478* (2013.01); *B01L 2400/0633* (2013.01); *B01L 2400/086* (2013.01)

(58) Field of Classification Search
None
See application file for complete search history.

(56) References Cited

U.S. PATENT DOCUMENTS 7,420,659 B1 * 9/2008 Cabuz ..... A61B 5/150969 356/39
2005/0169799 A1 8/2005 Sawa et al.
2009/0185955 A1 * 7/2009 Nellissen ..... B01L 3/502746 422/68.1

(Continued)

FOREIGN PATENT DOCUMENTS

JP 2003-166910 A 6/2003
JP 2008-183409 A 8/2008

(Continued)

OTHER PUBLICATIONS

Japanese Office Action for Japanese Application No. 2016-159106, dated May 19, 2020, with English translation.

*Primary Examiner* — Paul S Hyun
(74) *Attorney, Agent, or Firm* — Birch, Stewart, Kolasch & Birch, LLP

(57) ABSTRACT

Provided is a microfluidic chip. A microfluidic chip includes a main body portion and a first plunger. The main body portion includes a first fluid space for containing a first fluid and a first micro flow channel that is in communication with the first fluid space. The first plunger is capable of movement in the first fluid space so as to deliver the first fluid from the first fluid space to the first micro flow channel. According to the first aspect, a first fluid space for containing a first fluid such as a testing solution and a first plunger that delivers the first fluid from the first fluid space are provided. That is, a syringe composed of the first fluid space and the first plunger is provided, and it is therefore possible to deliver the first fluid by operating the syringe.

20 Claims, 3 Drawing Sheets

(56) References Cited

U.S. PATENT DOCUMENTS

| | | | | |
|---|---|---|---|---|
| 2010/0123457 | A1* | 5/2010 | Shinoda | B01L 3/502753 324/228 |
| 2015/0044696 | A1* | 2/2015 | Dothie | G01N 33/80 435/7.24 |
| 2017/0197216 | A1 | 7/2017 | Tsujimaru | |
| 2018/0371518 | A1 | 12/2018 | Tsujimaru | |

FOREIGN PATENT DOCUMENTS

| | | | |
|---|---|---|---|
| JP | 2008-268198 | A | 11/2008 |
| JP | 2009-288053 | A | 12/2009 |
| JP | 2009-300433 | A | 12/2009 |
| JP | 2012-237707 | A | 12/2012 |
| JP | 2015-14512 | A | 1/2015 |
| JP | 2016-516562 | A | 6/2016 |
| WO | WO 2010/151777 | A2 | 12/2010 |
| WO | WO 2016/121886 | A1 | 8/2016 |
| WO | WO 2017/018014 | A1 | 2/2017 |

* cited by examiner

MICROFLUIDIC CHIP

CROSS REFERENCE TO RELATED APPLICATION

This application claims a priority to Japanese Patent Application No. 2016-159106 filed on Aug. 15, 2016, which is hereby incorporated by reference in its entirety.

FIELD OF INVENTION

The present invention relates to a microfluidic chip.

BACKGROUND

Microfluidic chips are used primarily in research and development applications in biomedical, biochemical, and other fields. A microfluidic chip is a device in which a micro flow channel for conveying a fluid such as a reagent is formed, but it is often the case that the microfluidic chip itself does not have a function of conveying a fluid. For this reason, for example, it is necessary to additionally prepare a pump for conveying a fluid (see, for example, JP 2015-014512A). Methods are also proposed in which a microfluidic chip is rotated so as to convey a fluid by a centrifugal force (see, for example, JP 2009-300433A and JP 2008-268198A).

However, the method in which a pump is additionally prepared requires the use of a tube to connect the pump and the microfluidic chip, which increases the dead volume and makes operations complex. Also, the methods in which a fluid is conveyed by a centrifugal force are problematic in that the design of micro flow channel becomes complex, which compromises the degree of freedom in design.

SUMMARY OF INVENTION

It is an object of the present invention to provide a microfluidic chip in which a fluid can be easily conveyed.

A microfluidic chip according to a first aspect includes a main body portion and a first plunger. The main body portion includes a first fluid space for containing a first fluid and a first micro flow channel that is in communication with the first fluid space. The first plunger is capable of movement in the first fluid space so as to deliver the first fluid from the first fluid space to the first micro flow channel.

A microfluidic chip according to a second aspect is the microfluidic chip according to the first aspect, and the first fluid space includes a plurality of mutually separated spaces, and the first plunger includes a plurality of plungers that are respectively disposed in the plurality of spaces.

A microfluidic chip according to a third aspect is the microfluidic chip according to the first or second aspect, and the main body portion further includes a reaction space that is in communication with the first micro flow channel and in which the first fluid introduced from the first fluid space via the first micro flow channel is reacted.

A microfluidic chip according to a fourth aspect is the microfluidic chip according to the third aspect, and further includes an inlet port for introducing, into the reaction space, an analyte to be reacted with the first fluid.

A microfluidic chip according to a fifth aspect is the microfluidic chip according to the fourth aspect, and the main body portion further includes an analyte space that is in communication with the inlet port and in which the analyte introduced into the reaction space via the inlet port is contained.

A microfluidic chip according to a sixth aspect is the microfluidic chip according to the fifth aspect, and further includes a second plunger. The main body portion further includes a second fluid space for containing a second fluid and a second micro flow channel that is in communication with the second fluid space and the analyte space. The second plunger is capable of movement in the second fluid space so as to deliver the second fluid from the second fluid space to the analyte space via the second micro flow channel and thereby force out the analyte from the analyte space toward the reaction space.

A microfluidic chip according to a seventh aspect is the microfluidic chip according to any one of the third to sixth aspects, and the main body portion further includes a third micro flow channel that is in communication with the reaction space and a collecting space that is in communication with the third micro flow channel and in which the first fluid is collected from the reaction space via the third micro flow channel.

A microfluidic chip according to an eighth aspect is the microfluidic chip according to any one of the third to seventh aspects, and the main body portion includes a first member and a second member that is made of a material different from that of the first member and is jointed with the first member.

A microfluidic chip according to a ninth aspect is the microfluidic chip according to the eighth aspect, and the second member is made of a material having a higher light transmittance than that of the first member. The second member at least partially constitutes a side wall that defines the reaction space.

A microfluidic chip according to a tenth aspect is the microfluidic chip according to the eighth or ninth aspect, and the first member and the second member are adhesively attached via an adhesive sheet layer.

A microfluidic chip according to an eleventh aspect is the microfluidic chip according to any one of the first to tenth aspects, and further includes a plug. The plug forms a blocked state in which a flow of the first fluid from the first fluid space to the first microflow channel is blocked, and removes the blocked state.

According to the first aspect, a first fluid space for containing a first fluid such as a testing solution and a first plunger that delivers the first fluid from the first fluid space are provided. That is, a syringe composed of the first fluid space and the first plunger is provided, and it is therefore possible to deliver the first fluid by operating the syringe. Accordingly, the fluid can be conveyed with a simple configuration.

DETAILED DESCRIPTION OF THE PREFERRED EMBODIMENTS

Hereinafter, a microfluidic chip according to an embodiment of the present invention will be described with reference to the drawings.

1. Configuration of Microfluidic Chip

Figure 1:
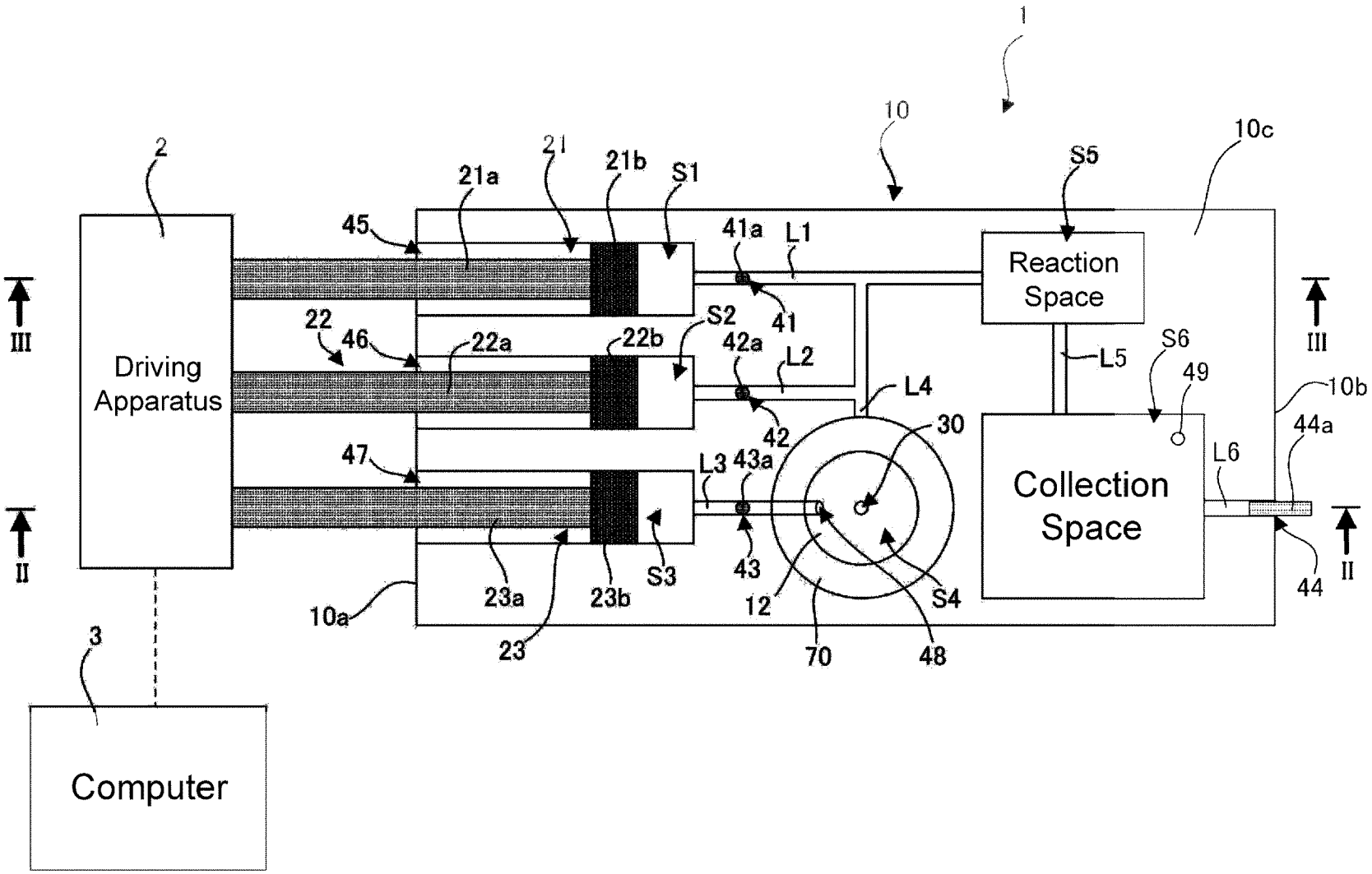
FIG. 1 is a diagram showing a configuration of a microfluidic chip according to an embodiment of the present invention and peripheral apparatuses connected to the microfluidic chip.
Figure 2:
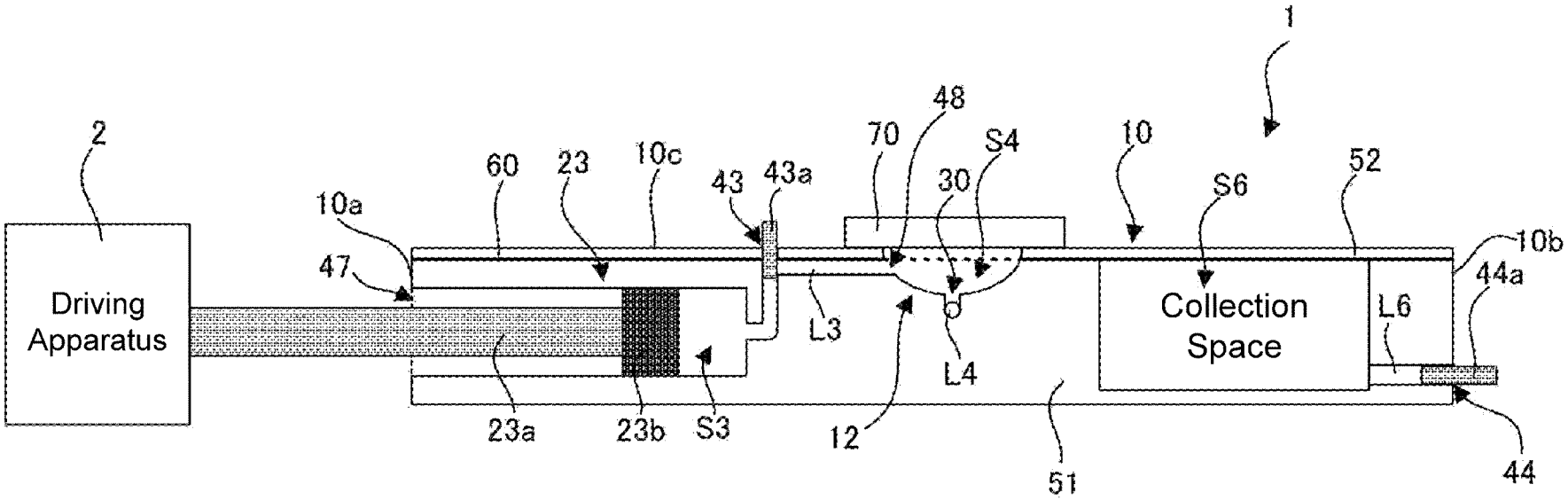
FIG. 2 is a cross-sectional view taken along the line II-II shown in FIG. 1.
Figure 3:
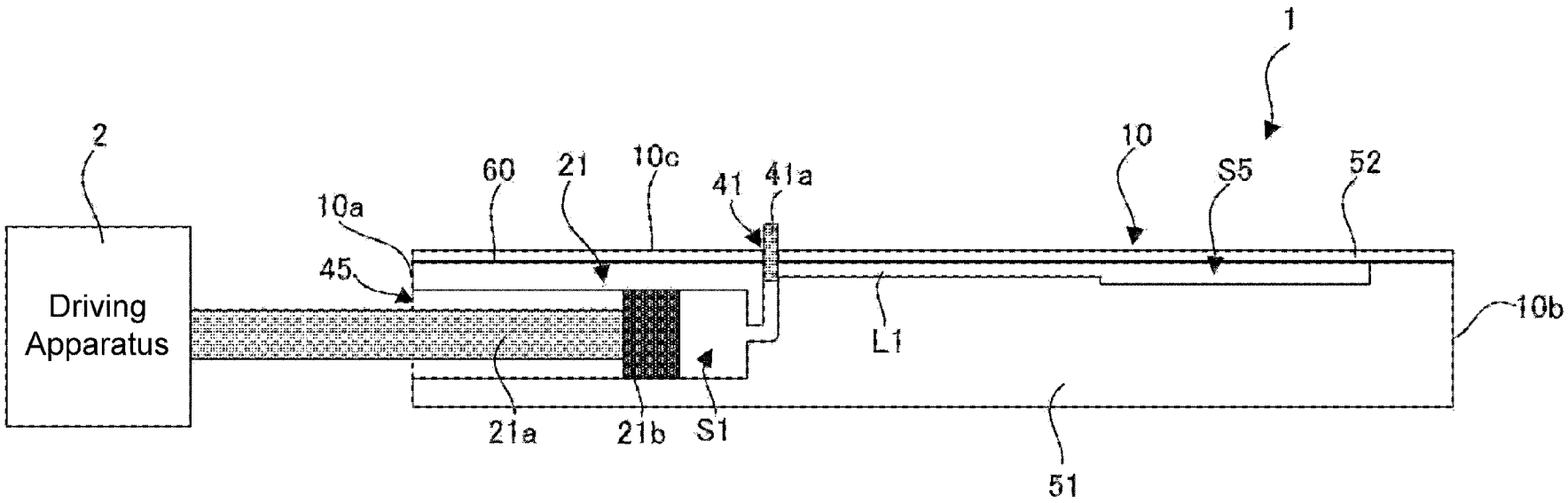
FIG. 3 is a cross-sectional view taken along the line shown in FIG. 1.

FIG. 1 shows a configuration of a microfluidic chip 1 according to the present embodiment and peripheral apparatuses that are connected to the microfluidic chip 1. The diagram shows a plan view of the microfluidic chip 1, and also shows a positional relationship between constituent elements such as micro-flow channels L1 to L6 that are formed in the microfluidic chip 1. FIGS. 2 and 3 are a cross-sectional view taken along the line II-II shown in FIG. 1 and a cross-sectional view taken along the line III-III shown in FIG. 1, respectively.

As shown in FIGS. 1 to 3, the microfluidic chip 1 includes a main body portion 10 that is in the form of a generally cubic block. In the main body portion 10, micro-flow channels L1 to L6 that are fine pipelines are formed, and also various spaces S1 to S6 that are in communication with the micro-flow channels L1 to L6 are formed. To be more specific, a plurality of (three in the present embodiment) fluid spaces S1 to S3, an analyte space S4, a reaction space S5, and a collecting space S6 are formed, and the spaces S1 to S6 are open spaces that are larger in size than the micro-flow channels L1 to L6. As used herein, the term "size" refers to the area of a plane vertical to a direction of movement of a fluid, which will be described later (the plane extending in the up-down direction in FIGS. 2 and 3 and parallel to the vertical direction). There is no particular limitation on the size, but the spaces S1 to S6 preferably have a size three times or more larger than the size of the micro-flow channels L1 to L6, and more preferably ten times or more larger. The size of the spaces S1 to S6 may be larger by a factor of 50 or more, or 100 times or more.

The microfluidic chip 1 can be used primarily in research and development applications in biomedical, biochemical, and other fields, but the applications are not limited thereto. The microfluidic chip 1 can also be used in POCT (point of care testing). In this case, typically, reagents are placed in the fluid spaces S1 and S2, and an analyte such as blood or urine to be tested by using the reagents is placed in the analyte space S4. The reagents and the analyte are usually in the form of a liquid, but they may, of course, be in the form of a gas. The reaction space S5 is a space in which the reagents and the analyte are mixed and reacted. The collecting space S6 is a space in which the reagents and the analyte after reaction are collected and at least temporarily stored.

The fluid space S1 is in communication with the micro-flow channel L1, and the micro-flow channel L1 is in communication with the reaction space S5. That is, the fluid space S1 is in communication with the reaction space S5 via the micro-flow channel L1. The fluid space S2 is in communication with the micro-flow channel L2, and the micro-flow channel L2 is in communication with the reaction space S5. That is, the fluid space S2 is in communication with the reaction space S5 via the micro-flow channel L2. The reaction space S5 is in communication with the micro-flow channel L5, and the micro-flow channel L5 is in communication with the collecting space S6. That is, the reaction space S5 is in communication with the collecting space S6 via the micro-flow channel L5. The collecting space S6 is in communication with the micro-flow channel L6, and the micro-flow channel L6 extends to a side surface 10*b* of the main body portion 10 and is in communication with an external space.

The fluid space S3 is in communication with the micro-flow channel L3, and the micro-flow channel L3 is in communication with the analyte space S4. That is, the fluid space S3 is in communication with the analyte space S4 via the micro-flow channel L3. The analyte space S4 is in communication with the micro-flow channel L4, and the micro-flow channel L4 is in communication with the reaction space S5. That is, the analyte space S4 is in communication with the reaction space S5 via the micro-flow channel L4. The fluid space S3 typically contains a fluid for forcing out the analyte from the analyte space S4 into the reaction space S5 via the micro-flow channel L4, and preferably an inactive fluid that does not react with the reagents and the analyte. For example, the fluid space S3 contains air. As used herein, the term "inactive" refers to reacting with the reagents and the analyte to such a degree that does not interfere with the testing of the analyte, rather than a fluid that does not at all react with the reagents and the analyte.

The fluid spaces S1 to S3 are tubular spaces (circular cylindrical spaces in the present embodiment) with one end side extending along a direction of the central axis thereof to a side surface 10*a* of the main body portion 10. In other words, the fluid spaces S1 to S3 are in communication with the external space respectively via openings 45 to 47 that are formed in the side surface 10*a* of the main body portion 10. The micro-flow channels L1 to L3 are in communication with the fluid spaces S1 to S3 at their end portions opposite to the side surface 10*a* of the main body portion 10.

Plungers 21 to 23 are inserted into the fluid spaces S1 to S3, respectively. The plungers 21 to 23 are configured to be capable of reciprocal movement in the fluid spaces S1 to S3 along the direction of the central axis of the fluid spaces S1 to S3, respectively. When the plungers 21 to 23 are inwardly pushed, the fluids contained in the fluid spaces S1 to S3 are delivered to the micro-flow channels L1 to L3, respectively. That is, in the microfluidic chip 1, a plurality of (three in the present embodiment) "syringes" are formed by the fluid spaces S1 to S3 and the plungers 21 to 23. The syringes implement a function of conveying the fluids contained in the fluid spaces S1 to S3.

The plungers 21 to 23 respectively have shafts 21*a* to 23*a* and gaskets 21*b* to 23*b* that are provided at inner-side tip ends of the shafts 21*a* to 23*a*. The gaskets 21*b* to 23*b* are capable of smoothly sliding along the side wall of the fluid spaces S1 to S3 and maintaining the airtightness of the fluid spaces S1 to S3, respectively. Accordingly, the gaskets 21*b* to 23*b* are typically made of a rubber material, and more preferably a butyl rubber with a small amount of extract. In order to improve the slidability of the plungers 21 to 23, it is preferable to apply a lubricant such as a silicone grease to at least one of the side wall of the fluid spaces S1 to S3 and the side surface of the gaskets 21*b* to 23*b*.

The plungers 21 to 23 can be moved manually, but in the present embodiment, they are connected to a driving apparatus 2 that is controlled by a computer 3. The computer 3 is capable of independently controlling, the operations of the plungers 21 to 23 via the driving apparatus 2. To be more specific, the computer 3 is capable of controlling the amount of movement of the plungers 21 to 23 and eventually the flow rate of various types of fluids delivered from the fluid spaces S1 to S3 as desired. The computer 3 is implemented as, for example, a general-purpose personal computer including a control portion such as a CPU, a storage device, an input device, and a display device, and the operator can set, via the input device, the amount of movement of the plungers 21 to 23, or in other words, the flow rate of various types of fluids flowing through the microfluidic chip 1. In the storage device, a dedicated program for causing the control portion to execute the above-described operations has been installed.

There is no particular limitation on the specific configuration of the driving apparatus 2 as long as the plungers 21 to 23 can be reciprocally moved in the fluid spaces S1 to S3. Since various methods for implementing such a mechanical operation are known, a detailed description thereof is omitted here, but just as an example, a stepping motor can be used to implement the mechanical operation. In this case, for example, the shafts 21*a* to 23*a* of the plungers 21 to 23 can be connected to the shafts of stepping motors via appropriate mechanisms that can convert a rotary motion to a linear motion.

As described above, in the microfluidic chip 1, the fluid spaces S1 to S3 for containing fluids and the plungers 21 to 23 for delivering the fluids from the fluid spaces S1 to S3 are provided. That is, syringes composed of the fluid spaces S1 to S3 and the plungers 21 to 23 are provided, and thus as a result of the syringes being operated, the fluids contained in the fluid spaces S1 to S3 can be delivered. Accordingly, it is possible to easily convey fluids with a simple configuration.

In the present embodiment, the analyte space S4 is defined by a "dish" 12 formed in an upper surface 10*c* of the main body portion 10. An opening 48 that is in communication with the microflow channel L3 is formed in a side surface of the dish 12 that defines the analyte space S4. Also, an inlet port 30 is formed in a bottom surface of the dish 12 that defines the analyte space S4, the inlet port 30 being an inlet port for introducing the analyte in the analyte space S4 into the reaction space S5 via the micro-flow channel L4 and being in communication with the micro-flow channel L4. With the configuration described above, when the plunger 23 is pushed in the fluid space S3, the fluid contained in the fluid space S3 is forced into the analyte space S4 via the micro-flow channel L3. At this time, the analyte in the analyte space S4 is forced into the micro-flow channel L4 via the inlet port 30 by the fluid that has flowed into the analyte space S4, and the analyte is eventually conveyed to the reaction space S5 via the micro-flow channel L4.

The main body portion 10 may be provided with a removable cover 70 for covering the analyte space S4. With this configuration, an analyte can be placed in the analyte space S4 by opening the cover 70. Also, after an analyte is placed in the analyte space S4*a*, it is possible to prevent the analyte in the analyte space S4 from being exposed to the ambient air and also prevent a contaminant and the like from entering the analyte space S4.

In the present embodiment, as shown in FIG. 1, the micro-flow channels L1, L2, and L4 meet with each other and then extend to the reaction space S5. Accordingly, in the present embodiment, the reagents and analyte delivered from the fluid spaces S1 and S2 and the analyte space S4 may be slightly mixed before reaching the reaction space S5. However, the micro-flow channels L1, L2, and L4 may be configured such that they meet with each other in the reaction space S5 without meeting with each other in a path to the reaction space S5.

Openings 41 to 43 extending to the upper surface 10*c* of the main body portion 10 are respectively formed in the paths constituting the micro-flow channels L1 to L3, and plugs 41*a* to 43*a* for blocking the flow of fluids in the micro-flow channels L1 to L3 are respectively inserted into the openings 41 to 43. As described above, because the micro-flow channels L1 to L3 are smaller in size than the spaces S1 to S3 in which fluids are contained, if the micro-flow channels L1 to L3 are not configured to block the flow of fluids, the fluids may gradually move due to a capillary action. The plugs 41*a* to 43*a* are provided to prevent such a situation. The plugs 41*a* to 43*a* are removed as appropriate when an analyte is tested by using the microfluidic chip 1, and can remove a blocked state in which the flow of fluids is blocked. It is of course possible to again fit the plugs 41*a* to 43*a* into the openings 41 to 43 after the plugs 41*a* to 43*a* have been removed, so as to again restore a blocked state and stop the flow of fluids as appropriate.

Likewise, an opening 44 that extends to the side surface 10*b* of the main body portion 10 is also formed in the path constituting the micro-flow channel L6. A plug 44*a* for blocking the flow of fluid in the micro-flow channel L6 is inserted into the opening 44. The plug 44*a* is also removable.

There is no particular limitation on the material of the plugs 41*a* to 44*a*, and it is possible to select from any material such as, for example, a metal, a resin, a rubber, and glass. From the viewpoint of mass production, it is preferable to select a metal or a resin. Also, it is preferable to select a material having a high corrosion resistance. In the case of a metal, SUS 304 or the like is preferably used. In the case of a resin, PP (polypropylene), PE (polyethylene), PET (polyethylene terephthalate), PMMA (polymethyl methacrylate), PC (polycarbonate) or the like is preferably used.

Also, in the collecting space S6, an opening 49 is formed that extends to the upper surface 10*c* of the main body portion 10. The opening 49 is an air vent for adjusting the pressure within the micro-flow channels L1 to L6 and the spaces S1 to S6 when the plungers 21 to 23 are pushed. A plug may be inserted into the opening 49 as well until the start of testing.

In the present embodiment, as shown in FIGS. 2 and 3, the main body portion 10 is produced by joining two upper and lower parts together, or to be more specific, a first member 51 that is on the lower side and a second member 52 that is on the upper side. The reaction space S5 and the collecting space S6 are formed in the first member 51 and each have an opening in the upper surface of the first member 51. The openings are closed by the second member 52 (except for the opening 49 formed in the second member 52). The analyte space S4 is formed in the first member 51 and the second member 52 and has an opening in the upper surface of the second member 52. The opening is closed by the cover 70 described above. The fluid spaces S1 to S3 are formed in the first member 51, and they do not extend to the upper surface of the first member 51. The micro-flow channels L1 to L5 are formed to be open primarily in the upper surface of the first member 51, extend along the upper surface of the first member 51, and extend downward in the vicinity of connection portions to the fluid spaces S1 to S3. In the first member 51, the micro-flow channel L6 is formed to extend to the side surface 10*b*, and does not extend to the upper surface of the first member 51.

In the present embodiment, by forming the microfluidic chip 1 by using the first member 51 and the second member 52 as configured described above, it is possible to relatively easily produce the main body portion 10 internally provided with a complex hollow pattern.

There is no particular limitation on the material of the first member 51 and the second member 52, and it is preferable to select from a resin, glass, PDMS (dimethyl polysiloxane), a rubber, or the like. Also, because a reaction that takes place in the reaction space S5 may be observed, in order to facilitate optical detection of the reaction, the first member 51 and the second member 52 are preferably made of a highly transparent material. From this point of view, it is preferable to, for example, select a resin material such as PMMA (polymethyl methacrylate), PC (polycarbonate), COC (cycloolefin copolymer), COP (cycloolefin polymer), or the like. Among them, it is particularly preferable to select COP because it has an excellent light transmittance. Note however that, in general, a highly light transmissive resin material is costly. From the viewpoint of optically detecting a reaction in the reaction space S5, it is sufficient that at least a portion of the side wall that defines the reaction space S5 is highly transparent, the portion being a portion to be observed. Accordingly, in the present embodiment, the first member 51 and the second member 52 are made of different materials. To be more specific, assuming that observation is made from above, the second member 52 on the upper side is made of a material having a higher light transmittance than that of the first member 51. For example, the second member 52 may be made of COP, and the first member 51 may be made of PMMA. In the case where the first member 51 and the second member 52 are made of different materials, it is of course possible to use a combination of a resin and a rubber, a combination of a resin and glass, a combination of a rubber and glass, other than a combination of different types of resins.

In the case where the first member 51 and the second member 52 are made of a resin material, the members 51 and 52 can be easily produced by, for example, injection molding. In this case, the opening 49 serving as an air vent, the openings 41 to 44, a part of the micro-flow channels L1 to L6, and the like can be formed by additional processing such as cutting, rather than forming them simultaneously at the time of injection molding.

Also, there is no particular limitation on the method for joining the first member 51 and the second member 52 together, but in the present embodiment, the two members 51 and 52 are adhesively attached via an adhesive sheet layer 60 that is made of an adhesive. This method is excellent in that in the case where the first member 51 and the second member 52 are made of different materials, adhesion between the two members 51 and 52 can be easily attained. The adhesive is preferably transparent and has a small amount of extract. For example, it is possible to select acrylic adhesive transfer tape 9969 available from 3M Japan Limited. In the case where the first member 51 and the second member 52 are made of the same material, it is also preferable to select a method in which the two members 51 and 52 are thermally fused together by heating the joined surface between the two members 51 and 52 to a melting point and pressing the two members 51 and 52.

2. Use of Microfluidic Chip

Hereinafter, an example of a method for using the microfluidic chip 1 will be described, but the method for using the microfluidic chip 1 is not limited thereto.

First, a microfluidic chip 1 is prepared, and the plugs 41*a* and 42*a* are removed. Then, reagents are injected into the fluid spaces S1 and S2 via the openings 41 and 42 by pulling the plungers 21 and 22. At this time, the gaskets 21*b* and 22*b* are left in the fluid spaces S1 and S2. After that, the micro-flow channels L1 and L2 are again blocked by the plugs 41*a* and 42*a*. Alternatively, reagents may be injected into the fluid spaces S1 and S2 via the openings 45 and 46 by removing the plungers 21 and 22 from the fluid spaces S1 and S2. It is also possible to prepare a microfluidic chip 1 in which reagents have been added in advance.

Likewise, the plug 43*a* is removed, and a sufficient amount of air is charged into the fluid space S3 via the opening 43 by pulling the plunger 23. At this time, the gasket 23*b* is left in the fluid space S3. After air has been charged, the plug 43*a* is inserted into the opening 43. Note however that the plug 43*a* is inserted to such a degree that the micro-flow channel L3 is not in communication with the external space via the opening 43. Accordingly, the plug 43*a* is not inserted to such a degree that the micro-flow channel L3 is blocked.

Next, the shafts 21*a* to 23*a* of the plungers 21 to 23 are connected to the driving apparatus 2. Furthermore, the cover 70 is opened to place an analyte in the analyte space S4. The analyte can be, for example, a biological origin component such as blood or urine. After the analyte has been placed, the cover 70 is closed to isolate the analyte space S4 from the external space.

Next, the plugs 41*a* and 42*a* are loosened. To be more precise, the plugs 41*a* and 42*a* are inserted to such a degree that the micro-flow channels L1 and L2 are not in communication with the external space via the openings 41 and 42, without blocking the micro-flow channels L1 and L2. If there is a plug attached to the opening 49, the plug is removed so as to cause the collecting space S6 to communicate with the external space via the air vent.

After completion of the above-described preparation, the computer 3 is operated to drive the driving apparatus 2. By doing so, the plungers 21 to 23 are moved forward by an appropriate distance at an appropriate speed. The forward speed and the forward distance of the plungers 21 to 23 are controlled independently of each other, and as a result, appropriate amounts of testing solutions and analyte are conveyed to the reaction space S5. The plungers 21 to 23 may be driven simultaneously, or may be driven in sequence. The testing solutions flow from the fluid spaces S1 and S2 to the reaction space S5 through the micro-flow channels L1 and L2. On the other hand, the analyte is pushed by the air forced out from the fluid space S3 into the analyte space S4, and reaches the reaction space S5 through the micro-flow channel L4.

In the reaction space S5, the fluids and the analyte are mixed to start a reaction (including a chemical reaction and a biochemical reaction). Then, the reaction is observed from the outside by using an experiment viewing instrument such as an optical microscope or with the naked eye so as to detect a change in the analyte. After completion of the reaction and the observation, the computer 3 is operated to drive the driving apparatus 2, and thereby the plunger 23 is moved forward. As a result, air can be delivered to the reaction space S5, and the air pushes the fluid after reaction to the collecting space S6.

Furthermore, after that, if necessary, similar testing can be repeatedly performed by placing a new analyte in the analyte space S4. If a cleaning solution is provided in advance in the fluid space S3 instead of air, or if a cleaning solution is introduced into the fluid space S3 after testing, the micro-flow channel L4, the analyte space S4, and the reaction space S5 can be cleaned each time testing ends, and thus the next testing can be performed in a cleaned state. Likewise, if a cleaning solution is provided in advance in one of the fluid spaces S1 and S2 or if a cleaning solution is introduced into one of the fluid spaces S1 and S2 after testing, the next testing can be performed in a more cleaned state.

After completion of testing, the microfluidic chip 1 may be immediately discarded, but the microfluidic chip 1 may be discarded after the fluid contained in the collecting space S6 is removed. In the case of the latter, the fluid contained in the collecting space S6 can be forced out to the external space via the micro-flow channel L6 by removing the plug 44*a* and causing the plunger 23 to move forward. At this time, the opening 49 is preferably closed with a plug or the like.

3. Variations

An embodiment of the present invention has been described above, but the present invention is not limited to the embodiment given above, and various modifications can be made without departing from the gist of the present invention. For example, the following modifications can be made. Also, the substances of variations given below can be combined as appropriate.

3-1

The analyte space S4 may be omitted. In this case, for example, in the reaction space S5, a reagent and a reagent can be mixed to react, rather than causing an analyte and a reagent to react. It is also possible to omit the analyte space S4 and place the analyte directly in the reaction space S5. In this case, for example, the reaction space S5 may be provided with an openable and closeable cover. The analyte can be introduced into the reaction space S5 via an inlet port formed as a result of the cover being opened. After that, the cover is closed so as to start a reaction of the analyte. Alternatively, an inlet port 30 that is in communication with the reaction space S5 may be provided in a side wall of the main body portion 10 that defines the reaction space S5, and the analyte can be introduced into the reaction space S5 via the inlet port 30.

3-2

The micro-flow channel L6 may be omitted. In this case, the microfluidic chip 1 can be discarded, with the fluid after reaction being left in the collecting space S6. Also, in addition to the micro-flow channel L6, it is also possible to omit the collecting space S6. Instead, the micro-flow channel L5 can be configured to be in communication with the external space. This embodiment is suitable when repetitive testing is not performed. It is also possible to omit all of the micro-flow channels L5 and L6 and the collecting space S6. In this case, the microfluidic chip 1 can be discarded, with the fluid after reaction being left in the reaction space S5.

3-3

The number of syringes each composed of a fluid space and a plunger is not limited to the number mentioned above, and may be one, two, four, or more. Also, the fluid delivered from such a syringe is not limited to an inactive fluid for forcing out the analyte or the reagents as described above, and may be, for example, a cleaning solution. The type of fluid contained in the syringe is selected as appropriate according to the intended use of the microfluidic chip 1.

3-4

In the embodiment given above, the main body portion 10 is composed of two members 51 and 52, but may be configured by joining three or more members together. The main body portion 10 may of course be composed of one member.

3-5

The number of reaction spaces S5 is not limited to the number mentioned above, and it is possible to provide a plurality of reaction spaces. The same applies to the collecting space S6.

REFERENCE SIGNS LIST

1 microfluidic chip
10 main body portion
21, 22 plunger (first plunger)
23 plunger (second plunger)
30 inlet port
41*a* to 44*a* plug
51 first member
52 second member
60 adhesive sheet layer
70 cover
S1, S2 fluid space (first fluid space)
S3 fluid space (second fluid space)
S4 analyte space
S5 reaction space
S6 collecting space
L1, L2 micro-flow channel (first micro-flow channel)
L3 micro-flow channel (second micro-flow channel)
L4 micro-flow channel
L5 micro-flow channel (third micro-flow channel)

The invention claimed is:

1. A microfluidic chip comprising:

a main body portion including a first fluid space for containing a first fluid, a first micro-flow channel that is in communication with the first fluid space, and a reaction space that is in communication with the first micro-flow channel and in which the first fluid introduced from the first fluid space, via the first micro-flow channel, is reacted;

a first plunger that is capable of movement in the first fluid space so as to deliver the first fluid from the first fluid space to the first micro-flow channel; and a plug configured to form a blocked state in which a flow of the first fluid from the first fluid space to the first micro-flow channel is blocked, the blocked state being released by the removal of the plug, wherein the main body portion further includes a second fluid space spaced from the first fluid space, wherein the microfluidic chip further comprises a second plunger disposed in the second fluid space to deliver a second fluid from the second fluid space to a second micro-flow channel, and wherein the reaction space is configured to simultaneously contain the first fluid delivered from the first fluid space and the second fluid delivered from the second fluid space to conduct a reaction of the first fluid and the second fluid.

2. The microfluidic chip according to claim 1, wherein the main body portion further includes a reaction micro-flow channel that is in communication with the reaction space and a collecting space that is in communication with the reaction micro-flow channel and in which the first fluid is collected from the reaction space via the reaction micro-flow channel.

3. The microfluidic chip according to claim 1, wherein the main body portion includes a first member and a second member that is made of a material different from that of the first member and is jointed with the first member.

4. The microfluidic chip according to claim 3, wherein the second member is made of a material having a higher light transmittance than that of the first member, and the second member at least partially constitutes a side wall that defines the reaction space.

5. The microfluidic chip according to claim 3, wherein the first member and the second member are adhesively attached via an adhesive sheet layer.

6. The microfluidic chip of claim 1, wherein the main body portion further includes an analyte space that is in communication with an inlet port of the reaction space and in which an analyte introduced into the reaction space via the inlet port is contained, and wherein the analyte space is spaced from the reaction space.

7. The microfluidic chip of claim 6, wherein the second plunger is further configured to deliver the second fluid from the second fluid space to the analyte space via the second micro-flow channel to force the analyte out from the analyte space toward the reaction space.

8. The microfluidic chip of claim 6, wherein the first plunger is configured to move in the first fluid space to deliver the first fluid from the first fluid space to the first micro-flow channel and then deliver the first fluid from the first micro-flow channel to the reaction space without the first fluid entering the analyte space.

9. The microfluidic chip of claim 6, further comprising:

a third fluid space for containing a third fluid; and a third micro-flow channel in communication with the third fluid space, wherein the analyte space is formed into a dish-shaped surface of the main body portion and the dish-shaped surface includes an opening connected to the third micro-flow channel.

10. A microfluidic chip, comprising:

a main body portion including:

a first fluid space for containing a first fluid;

a first micro-flow channel in communication with the first fluid space;

a second fluid space for containing a second fluid;

a second micro-flow channel in communication with the second fluid space;

a reaction space that is in communication with the first and second micro-flow channels via an inlet port of the reaction space and in which the first and second fluids are reacted, the inlet port being for introducing, into the reaction space, an analyte to be reacted with the first fluid; and an analyte space that is in communication with the inlet port of the reaction space and in which the analyte introduced into the reaction space via the inlet port of the reaction space is contained;

a first plunger that is configured to move in the first fluid space to deliver the first fluid from the first fluid space to the first micro-flow channel; and a second plunger that is configured to move in the second fluid space to deliver the second fluid from the second fluid space to the second micro-flow channel, wherein the analyte space is spaced from the reaction space, wherein the inlet port of the reaction space is configured to introduce the analyte into the reaction space to be reacted with the first and second fluids, and wherein the second plunger is further configured to deliver the second fluid from the second fluid space to the analyte space via the second micro-flow channel to force out the analyte from the analyte space toward the reaction space.

11. The microfluidic chip according to claim 10, wherein the main body portion includes a first member and a second member that is made of a material different from that of the first member and is jointed with the first member.

12. The microfluidic chip according to claim 11, wherein the second member is made of a material having a higher light transmittance than that of the first member, and the second member at least partially constitutes a side wall that defines the reaction space.

13. The microfluidic chip according to claim 11, wherein the first member and the second member are adhesively attached via an adhesive sheet layer.

14. The microfluidic chip of claim 10, wherein the reaction space includes an outlet connected to a collecting space, the collecting space being spaced from the reaction space and from the analyte space.

15. A microfluidic chip, comprising:

a main body portion including:

a first fluid space for containing a first fluid;

a first micro-flow channel in communication with the first fluid space;

a second fluid space for containing a second fluid;

a second micro-flow channel in communication with the second fluid space;

a reaction space that is in communication with the first and second micro-flow channels via an inlet port of the reaction space and in which the first and second fluids are reacted, the inlet port being for introducing, into the reaction space, an analyte to be reacted with the first fluid; and an analyte space that is in communication with the inlet port of the reaction space and in which the analyte introduced into the reaction space via the inlet port of the reaction space is contained;

a first plunger within the first fluid space to deliver the first fluid to the first micro-flow channel; and a second plunger that is capable of movement in the second fluid space so as to deliver the second fluid from the second fluid space to the analyte space via the second micro-flow channel to force out the analyte from the analyte space toward the reaction space, wherein the analyte space is spaced from the reaction space, wherein the inlet port of the reaction space is configured to introduce the analyte into the reaction space to be reacted with the first and second fluids, and wherein the first plunger is configured to move in the first fluid space to deliver the first fluid from the first fluid space to the first micro-flow channel and then deliver the first fluid from the first micro-flow channel to the reaction space without the first fluid entering the analyte space.

16. The microfluidic chip of claim 15, further comprising:

a third fluid space for containing a third fluid; and a third micro-flow channel in communication with the third fluid space, wherein the analyte space is formed into a dish-shaped surface of the main body portion, and the dish-shaped surface includes an opening connected to the third micro-flow channel.

17. The microfluidic chip according to claim 15, wherein the main body portion includes a first member and a second member that is made of a material different from that of the first member and is joined with the first member.

18. The microfluidic chip according to claim 17, wherein the second member is made of a material having a higher light transmittance than that of the first member, and the second member at least partially constitutes a side wall that defines the reaction space.

19. The microfluidic chip according to claim 17, wherein the first member is adhesively attached to the second member via an adhesive sheet layer.

20. The microfluidic chip of claim 15,
wherein the reaction space includes an outlet connected to a collecting space, the collecting space being spaced from the reaction space and from the analyte space.

* * * * *